US008381331B2

(12) United States Patent
Sharps et al.

(10) Patent No.: US 8,381,331 B2
(45) Date of Patent: Feb. 26, 2013

(54) PATIENT-ROTATION SYSTEM WITH CENTER-OF-GRAVITY ASSEMBLY

(75) Inventors: Lewis Sharps, Bryn Mawr, PA (US); Alan Dean Romig, Stansbury Park, UT (US)

(73) Assignee: Operating Room Safety Enterprises, LLC, Berwyn, PA (US)

( * ) Notice: Subject to any disclaimer, the term of this patent is extended or adjusted under 35 U.S.C. 154(b) by 341 days.

(21) Appl. No.: 12/753,050

(22) Filed: Apr. 1, 2010

(65) Prior Publication Data

US 2010/0293713 A1 Nov. 25, 2010

Related U.S. Application Data

(60) Provisional application No. 61/165,897, filed on Apr. 1, 2009.

(51) Int. Cl.
*A61G 7/10* (2006.01)

(52) U.S. Cl. ..... 5/86.1; 5/607; 5/611; 5/81.1 R

(58) Field of Classification Search ..... 5/607, 609, 5/611–613, 86.1, 81.1 R
See application file for complete search history.

(56) References Cited

U.S. PATENT DOCUMENTS

| | | | | |
|---|---|---|---|---|
| 3,202,218 | A * | 8/1965 | Watts et al. | 166/356 |
| 3,750,659 | A | 8/1973 | Loomans | |
| 4,029,089 | A | 6/1977 | Mulholland | |
| 4,296,761 | A | 10/1981 | Tyo | |
| D307,055 | S | 4/1990 | Johnston | |
| 5,131,106 | A | 7/1992 | Jackson | |
| D347,604 | S | 6/1994 | Ernst et al. | |
| D356,527 | S | 3/1995 | Wohnsen et al. | |
| 5,489,258 | A | 2/1996 | Wohnsen et al. | |
| 5,618,055 | A | 4/1997 | Mulholland | |
| 6,154,901 | A | 12/2000 | Carr | |
| 6,526,610 | B1 | 3/2003 | Hand et al. | |
| 6,941,951 | B2 | 9/2005 | Hubert et al. | |
| 7,036,512 | B2 | 5/2006 | Harnois | |
| 7,137,160 | B2 | 11/2006 | Hand et al. | |
| 7,152,261 | B2 | 12/2006 | Jackson | |
| 7,197,778 | B2 | 4/2007 | Sharps | |
| 7,343,635 | B2 * | 3/2008 | Jackson | 5/611 |
| 7,343,916 | B2 | 3/2008 | Biondo et al. | |
| 7,520,008 | B2 | 4/2009 | Wong et al. | |
| 7,614,639 | B2 | 11/2009 | Tholkes et al. | |
| D612,942 | S | 3/2010 | Verdon-Roe | |
| 2006/0242765 | A1 | 11/2006 | Skripps et al. | |
| 2007/0174966 | A1 * | 8/2007 | Lopez-Sansalvador | 5/607 |
| 2007/0192960 | A1 | 8/2007 | Jackson | |
| 2009/0282614 | A1 | 11/2009 | Jackson | |
| 2010/0024128 | A1 | 2/2010 | Skripps | |

OTHER PUBLICATIONS

Allen Medical Systems, "Intraoperative Adjustment from Kyphosis to Lordosis", Announcement Allen Medical Systems, Feb. 6, 2006, pp. 1-4.

The PCT Search Report mailed Feb. 17, 2011 for PCT Application No. PCT/US2010/052740.

"Radiolucent Wilson Frame", Orthopedic Systems, Inc. (OSI), Poster, 1998, 1 page.

* cited by examiner

*Primary Examiner* — Fredrick Conley
(74) *Attorney, Agent, or Firm* — Offit Kurman, P.A.; Robert R. Axenfeld

(57) ABSTRACT

A system for turning a person from a supine position to a prone position and vice versa includes opposing patient support platens each coupled to a corresponding end of a first and a second COG assembly, the first and second COG assemblies each coupled to a corresponding one of a pair of spindles, each one of the spindles disposed on a corresponding lift column. Embodiments described herein provide for an axis of rotation that is adjustable with respect to the plane of either an upper or lower support platen. Embodiments provide for adjusting the separation distance between the axis of rotation and the center of gravity defined by the combination of the person and the supporting platens.

15 Claims, 7 Drawing Sheets

PATIENT-ROTATION SYSTEM WITH CENTER-OF-GRAVITY ASSEMBLY

CROSS REFERENCE TO RELATED APPLICATIONS

The present patent application claims benefit of U.S. Provisional Application Ser. No. 61/165,897 filed on 1 Apr. 2009 entitled Patient-Transfer System with Horizontal-Center-of-Gravity (COG) Rotational Assembly, incorporated herein by reference.

FIELD OF ART

This patent application is directed to a system for rotating, transferring, positioning, or lifting a patient for purposes of performing a medical procedure where a patient is rotated from a supine position to a prone position, and vice versa. The apparatus may be used for transferring a patient to and from an operating table.

BACKGROUND

Generally, surgeries and procedures performed to the posterior of a patient require the patient to be positioned in a prone position to provide access to a surgical site. Prior to performing the surgery, protocol typically requires that the patient be anesthetized and intubated while lying on their back. For the vast majority of back surgeries performed in the United States today, most patients are still anesthetized on a gurney, and then manually lifted, inverted and deposited on an operating table.

There are many challenges associated with the transfer of the patient to the operating table from the gurney, and vice versa. The manual process of transfer is physically demanding and non-physiologic for the staff, and is potentially unsafe for the anesthetized patient. For instance, an anesthetized patient who is in an unconscious state has absolutely no control over their appendages and head, which all have a tendency to flop-down from gravity. If any appendages are not properly supported, it is possible to break, dislocate, or otherwise injure the patient's neck, shoulder area, and/or appendages while manually lifting and inverting the patient. Additionally, the patient may have a preexisting disease or injury to the spine, which if moved or twisted improperly could cause damage or paralysis to the patient. Thus, the staff must remain vigilant to properly support the appendages and body of the patient each time the patient is lifted and inverted. There is also a potential to accidentally lose control of or drop a patient incurring injury to the patient and/or staff.

Additionally, an anesthetized patient assumes "dead weight" which makes that person feel heavier. The weight of the patient exposes staff members, such as nurses, assistants, and doctors, to injuries when lifting the patient. Often times a staff member must lean across a gurney or operating room table exposing themselves to lifting injuries. Sometimes, the weight of the patient is not evenly distributed potentially risking injury to a staff member or patient. Accordingly, liability issues arise when patients are dropped or injured while being oriented on the operating table while sedated. Doctors and hospitals are also exposed to liability when operating staff are injured lifting and positioning sedated patients.

A further potential problem associated with turning the patient from his/her stomach or back involves the potential for patient motion or staff interference with life-support and life-monitoring systems that may be attached to the patient, such as an intravenous line, a catheter, electrode monitoring lines for monitoring the patient's vital signs, and an endotracheal tube for the purposes of administering oxygen and/or anesthesia to the patient. If any one of these life-support or life-monitoring systems is pulled out, crimped, or twisted, it can injure the patient and/or the operating staff.

Still another complication associated with manually lifting and inverting a patient onto an operating table for back surgery involves positioning the patient in proper alignment on the table. Some patients are placed on a "Wilson Frame" to properly align the back properly thereby and enhancing proper ventilation. The Wilson Frame allows the abdomen to hang pendulous and free. It is often difficult to manually manipulate the patient once placed onto the operating table to ensure proper alignment with the Wilson Frame underneath the patient.

Other ancillary problems involve positioning of the head, chest, and legs with proper support and access for devices such as the endotracheal tube. Anthropometric considerations, such as patient size, including weight and width, cause the operating staff to ensure that proper padding and elevations are used to support the head, chest, and legs. It is not uncommon to find operating staff stuffing pillows or bedding underneath a patient to adjust for different anthropometric features of a patient.

Attempts have been made to solve the transfer problems described above including systems which can turn rotate a patient. Unfortunately, many such systems for turning a patient have an axis of rotation and a center of gravity that are different. In such systems the separation of the rotation axis and the center of gravity make the system "top-heavy", or unbalanced, and therefore it is difficult to manually turn a patient. Furthermore, the unbalanced load creates greater stresses on the mechanical equipment and presents greater risk of mechanical failure to the patient.

SUMMARY

Described herein is a patient-safety-transfer system for rotating, transferring, positioning, or lifting a patient for purposes of performing a medical procedure where a patient is rotated from a supine position to a prone position, and vice versa. The system may be used for lifting, positioning, rotating and/or transferring an anesthetized patient for purposes of performing posterior surgery, and related medical procedures.

In one embodiment, the system includes first and second center-of-gravity (COG) assemblies. Opposing patient-support platens—an anterior platen (for abutting the front portions of the patient) and a posterior platen (for abutting back portions of the patient)—are coupled to a corresponding end of the first and second COG assemblies. The first and second COG assemblies are each coupled to a corresponding one of a pair of floating-spindle heads. Each one of the floating-spindle heads is disposed on a corresponding lift column. The COG assemblies provide for an axis of rotation that is outside the plane of platens upon which the patient is disposed. Specifically, the system provides a rotation axis outside the plane of either subjacent or superjacent patient-support platform, and more closely aligned with the center-of-gravity.

In other embodiments, the COG assemblies adjust a separation distance between the axis of rotation and the center-of-gravity defined by a combination of the patient and the supporting platens.

Achieving controlled patient pad compression is a precondition to safely clamp, secure, pick up, and rotate a patient 180 degrees from prone to supine position, or supine to prone position. To achieve optimal compression, in another embodiment, a lost-motion-over-travel system prevents the platens from continuing to travel toward the patient when lowering a platen toward to the patient, once optimal compression forces exerted on the patient via a platen (and/or the platen's constituent-support padding) is obtained.

In yet another embodiment, registration plates, coupled to the system, conveniently align the attachment mechanisms of each COG assembly with distal ends of one or more platens. For instance, when the anterior platen is placed on the surface of an operating table and is detached from the system, the distal ends of the anterior platen may telescopically extend beyond the ends of the table. When retrieving a patient from the operating table, the registration plates allow for medical staff to align the system so that it straddles the operating table with the attachment mechanisms of the COG assembly in alignment with platen tubes (or other complimentary attachment mechanisms) located at the distal ends of the anterior platen.

The system eliminates the need for operating room staff to manually lift and place an anesthetized patient in prone or supine positions. The system also provides safety for the patient and for medical staff charged with turning the patient. The system includes powered-lift columns that lift and lower platens between which a patient is disposed. The powered-lift columns, in embodiments described herein, are typically electrically powered, but it is appreciated by those skilled in the art having the benefit this disclosure, that these powered-lift columns are not so limited and may be powered by any suitable means including but not limited to hydraulics and pneumatics.

Various embodiments described herein provide a solution to achieve an optimum center-of-gravity (i.e., a balanced load) between platens, having a patient sandwiched therein, to the rotation axis of two rotation spindles. With an optimized center-of-gravity relative to the spindle axis, personnel are provided with the optimal-balanced load for manually rotating the patient 180 degrees. This provides a safe condition for both patient and staff while the patient is rotated from the supine to prone position, or from the prone to supine position.

Various embodiments of the present invention include several mechanical elements, assemblies and subsystems, such as, but not limited to, dual-rack-and-pinion subsystems, lost motion devices, gas shock absorbers, and ratchet and pawl subsystems. These mechanical elements, assemblies, and subsystems are combined in a unique manner to provide a patient safety transfer system operable to safely rotate a patient from a supine to prone position, and from a prone to supine position.

Regarding the exemplary dual-rack-and-pinions, each of these allow a top set of racks to extend simultaneously with the lower set of racks. This is used in the COG assembly (described in greater below) and provides a self-centering function. With respect to lost-motion devices, in most applications the driven load stops moving when it contacts a fixed stop and the powered device continues to lower in a free state.

Gas-shock absorbers are used to counter-act large weights in many mechanisms such as a rear hatch door in a vehicle. The gas-shock absorbers are sized to each application in order to reduce free energy caused by gravity as well as provide an ergonomic, realistic amount of energy for human beings to safely perform a given manual function, such as, in the embodiments, rotating a patient from supine to prone and vice versa.

Ratchet-and-pawl systems provide mechanisms with the ability to back-drive in one direction and catch in the opposite direction of rotation as is used in the adjustable frame system.

The various embodiments are part of an illustrative patient-safety-transfer system that includes a lift-column assembly that is mounted to a portable-caster-base assembly. Each caster-base assembly is tied to the other with a drawbar that has an operating position (as shown FIG. 1) and a collapsed-storage position (not shown). A floating-spindle-head assembly is mounted on top of each lift-column assembly. A COG assembly is mounted to the inboard side of each floating-spindle-head assembly with a spindle shaft allowing for rotation of the COG assembly. The COG assembly adjusts open and shut with a dual-rack-and-pinion device to open both or close both posterior and anterior shafts simultaneously. A platen-latch assembly is mounted to each end of the COG assembly to manually lock onto the platen tubes located at the distal ends of each platen. Each COG assembly has one platen-latch assembly for the posterior platen and one latch assembly for the anterior platen.

One posterior platen is used for the posterior side of patients and has two telescoping shafts to provide a safety distance (approximately 6.0 inches in one embodiment, but other suitable distances may be implemented) between the COG-platen latches and the patient, while the patient is lying on the platen. Platen-tube extensions can be collapsed so as to be flush with an operating table when a transfer or rotation is complete in order to provide patient access during an operating room procedure.

One anterior platen is used for the anterior side of patients and also has two telescoping devices to provide patients a safe distance away from the COG assembly during the hook-up phase of the transfer. A safety-belt system (one or more safety belts) is used to engage the posterior platen and the anterior platens together for the rotate, or patient turning, phase. Padding may be coupled to the safety-belt system to help ensure appendages of the patient are secured while rotated.

Pre-stage conditions for an illustrative embodiment describe specifics of the lowering function, latching of COG assembly to posterior and anterior platens, COG self centering features, COG assembly-self-centering-ratchet-and pawl-functions, and finally the spindle-lost motion functions. More particularly, the pre-stage conditions are: (1) the posterior platen is manually pre-staged onto the operating room (OR) table and each telescopic end of the platen is advanced into a locked position; (2) a patient is positioned on top of the posterior platen for rotation into the prone position; (3) the upper and lower dual-rack-and-pinion shafts of each COG assembly are extended and locked into their fully extended positions; (4) the anterior platen assembly is already locked onto its respective COG latches and is rotated in a ready-to-receive position over the top of the patient lying on the posterior platen and operating table; (5) the floor frame system has already been located to the lower platen with a caster-base-mounted registration plate; (6) all casters are locked in-position; and (7) the linear actuator drive is powered-on.

In practice, a staff member of the hospital or similar facility controls a pendant button in order to lift or lower platens onto or off from the operating table. When the pendant button (or other suitable control mechanism) for lowering is actuated, both linear actuator devices lower simultaneously with respect to each other. The pendant button is depressed and two lift columns lower the COG assemblies. The anterior-frame latch mechanism mounted on each of the COG assemblies fully nest over the platen tubes during this downward motion. Once contact with the platen tubes has occurred, the dual rack and pinion system of the COG assemblies begins to close and the COG-assembly-release-mechanism ratchet-and-pawl device begins to back-drive and the platens adjust themselves to the size of patient (vertical thickness). During this downward self-adjusting motion, the anterior platen foam pads eventually make contact with the patient and a controlled patient pad compression is reached. The anterior platen, the two COG assemblies, and the two spindle assemblies stop lowering while the linear motion columns are free to continue traveling until a limit switch is made (approximately two inches of travel). This provides a safe and reliable system for patients, and provides staff members with peace of mind that this system can safely perform its function.

The posterior platen is latched onto the dual-rack-and-pinion shafts of the COG assembly. The pad compression system is checked and adjusted by manually pulling the anterior platen down until a safe amount of pad compression is achieved. Next, safety belts are attached to the mushroom head pins and belts are cinched to secure the patient. Finally the lift and rotate functions are achieved.

Further details and advantages of a patient transfer system will become apparent with reference to the accompanying drawings and the following detailed description.

BRIEF DESCRIPTION OF THE DRAWINGS

The detailed description is presented with reference to the accompanying figures. In the figures, the left-most digit(s) of a reference number identifies the figure in which the reference number first appears. It is emphasized that the various features in the figures are not drawn to scale, and dimensions of the various features may be arbitrarily increased or reduced for clarity of discussion.

DETAILED DESCRIPTION

Reference herein to "one embodiment", "an embodiment", or similar formulations, means that a particular feature, structure, operation, or characteristic described in connection with the embodiment, is included in at least one embodiment. Thus, the appearances of such phrases or formulations herein are not necessarily all referring to the same embodiment. Furthermore, various particular features, structures, operations, or characteristics may be combined in any suitable manner in one or more embodiments.

Terminology

The expression "center-of-gravity" refers to the point at which the resultant gravitational force acts upon an object. The center of gravity is not necessarily inside the object. For example, the center of gravity of a ring is at the center of symmetry. If the geometry of the object does not change with time, the center of gravity will remain unchanged in relation to the object. In embodiments described herein, the center-of-gravity changes as patients placed in and removed from the system.

As used herein the expression "operating table" refers to general operating room tables, medical procedural tables, x-ray tables, and potentially other surfaces for performing a medical procedure usually under sedation and/or general anesthesia. The term "gurney" and "gurney-like," refers to a mobile platform used in a facility, such as a hospital, to move a patient that is lying down.

The term "over travel", as used herein refers to the distance over which the moving member(s) travel after a platen has come to rest on a support structure.

The term "platen", as used herein refers to an assembly having a framework and a patient support area disposed within an area defined by the framework. The term "anterior platen" generally refers to the platen which is configured to support the anterior side of a patient. The term "posterior platen" generally refers to the platen which is configured to support the posterior side of the patient. While specific examples may refer to one or the other, it should be appreciated by those skilled in the art, that either platen is interchangeable with the other, and such terminology is not necessarily intended to limit the scope of the claims.

The term "prone" refers to a patient lying face downward.

The term "supine" refers to a patient lying face upward.

The expression "ratchet-and-pawl system" refers to a mechanism having the ability to back-drive in one direction and catch in the opposite direction of rotation.

System Overview

Figure 1:
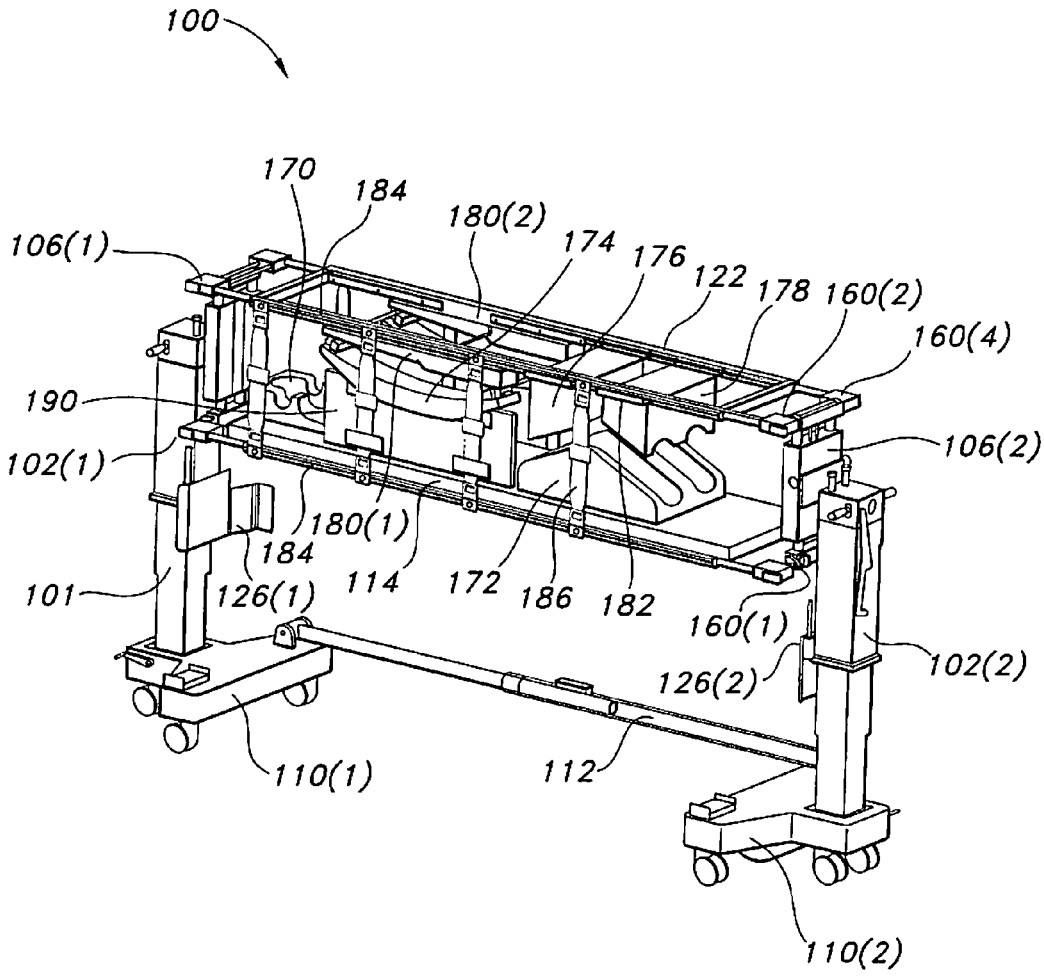
FIG. 1 shows a perspective view of an exemplary patient-safety-transfer system.

Described herein is a patient-safety-transfer system configured to lift, rotate, and transfer a patient to/from an operating table. An embodiment of the patient-safety-transfer system 100 is depicted in FIG. 1. The primary components of system 100, include a chassis 101, powered-lift columns 102(1), 102(2), center-of-gravity (COG) assemblies 106(1), 106(2), spindle assemblies 108(1), 108(2), portable-caster-base assemblies 110(1), 110(2), a drawbar 112, a posterior platen 114, an anterior platen 122, and registration plates 126(1), 126(2).

Chassis 101 serves as a framework for apparatus 100, which is configured to straddle an OR table. Chassis 101 includes two portable-caster-base assemblies 110(1), 110(2). Portable-caster-base assemblies 110 are coupled to each other by drawbar 112. Drawbar 112 includes an operating position, and a second collapsible-storage position. In the collapsible-storage position, drawbar 112 slidably folds together, which enables storage or transportation of system 100.

Powered-lift columns 102(1), 102(2), in embodiments described herein, are typically electrically powered, but it is appreciated by those skilled in the art having the benefit this disclosure, that these powered-lift columns are not so limited and may be powered by any suitable means including but not limited to hydraulics and pneumatics. 102(1), 102(2) are located at distal ends of drawbar 112. Powered-lift columns 102(1), 102(2) vertically extend and retract allowing for adjustability in height of platens 114 and 122. In one embodiment, the height of both powered-lift columns 102(1), 102(2) move in unison. Powered-lift columns 102 may incorporate actuators (not shown) that telescopically expand and contract each column to control their height.

Figure 1A:
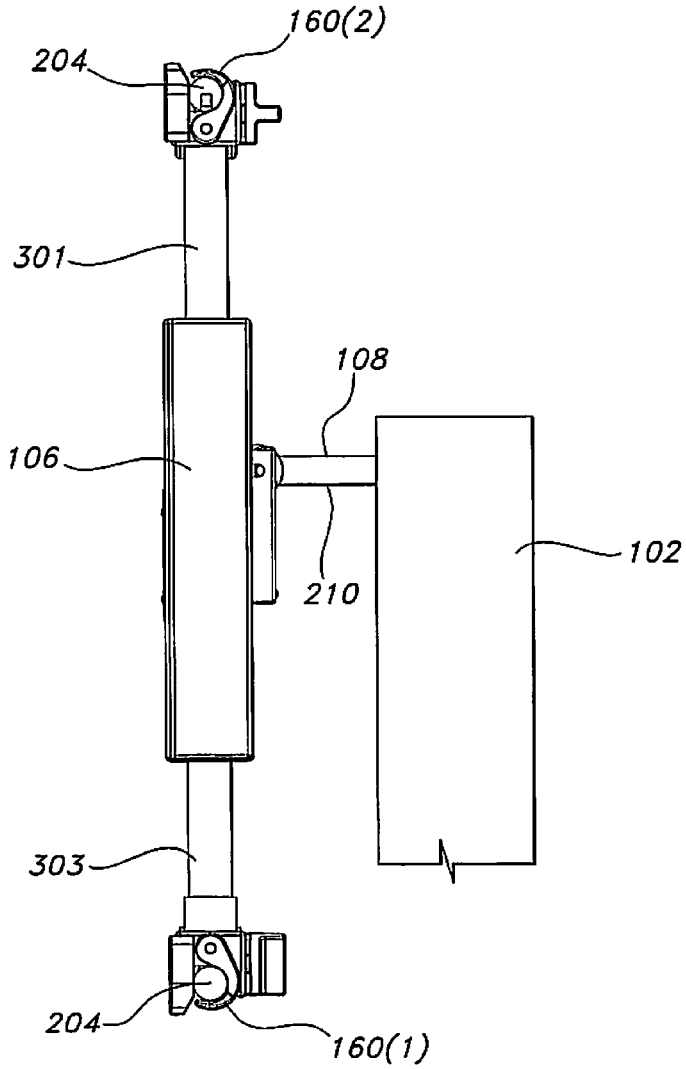
FIG. 1A shows a side view a center-of-gravity assembly coupled to a spindle assembly, which is mounted on an inside portion of a powered-lift column.

Attached to the powered-lift columns 102 are a pair of rotation systems including COG assemblies 106(1), 106(2) each coupled to respective spindle assemblies 108(1), 108(2) (which are obstructed in FIG. 1). FIG. 1A shows a side view a COG assembly 106 coupled to a spindle assembly 108, which is mounted on an inside portion of powered-lift column 102. Still referring to FIG. 1A, each COG assembly 106 includes internal assemblies (to be described) which facilitate the securing of a patient between posterior and anterior platens 114 and 122 (shown in FIG. 1). Each COG assembly 106 includes two opposing pairs of latch assemblies 160(1), 160 (2) for releasably connecting posterior platen 114 and anterior platen 122 to system 100. Because of the side view, in FIG. 1A, only two out of the four latch assemblies can be seen.

Figure 2:
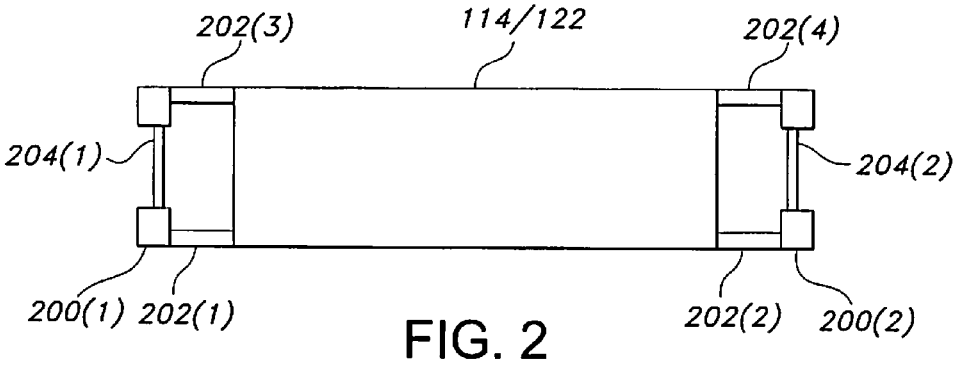
FIG. 2 is a top-outline view of a platen.

Referring to FIG. 2, is top-outline view of a platens 114/122. At the distal ends 200(1), 200(2) of platen 114/122 are extension telescoping shafts 202(1), 202(2), 202(3), 202(4). Connected to the telescoping shafts 202 are platen tubes 204 (1), 204(2), which are generally perpendicular to the telescoping shafts 202. Telescoping shafts 202 slide in and out of platens 114/122. When connected to COG assemblies 106 (FIG. 1), telescoping shafts 202 are extended several inches. When disconnected from COG assemblies 106, telescoping shafts 202 may be retracted so that these shafts 202 and platen tubes 204 may be coextensive or in the boundaries of the operating-table surface.

Referring back to FIG. 1A, each of latch assembly 160 releasably attaches to platen tubes 204. Each spindle assembly 108 is mounted on a top portion of each column 102. COG assembly 106 is mounted to an inboard side of each spindle assembly 108 with a spindle shaft 210 allowing for rotation of the COG assembly 106. COG assembly 106 adjusts a latching open and shut with a dual rack and pinion device to open both or close both posterior and anterior shafts simultaneously. A platen latch assembly is mounted to each end of the COG assembly in order to manually lock onto the platen tubes. Each COG assembly has one platen latch assembly for the posterior platen and one latch assembly for the anterior platen. One posterior platen is used for the posterior side of patients and has two telescoping shafts to provide a safety distance (approximately 6.0 inches) between the COG platen latches and the patient, while the patient is lying on the platen. Platen tube extensions can be collapsed when a transfer or rotation is complete in order to provide patient access during an operating room procedure. One anterior platen is used for the anterior side of patients and also has two telescoping devices to provide patients a safe distance away from the COG assembly during the hook-up phase of the transfer. One safety belt system is used to engage the posterior platen and the anterior platens together for the rotate, or patient turning, phase.

Referring back to FIG. 1, occipital padding 170 and a leg bolster 172 may be placed on a planar surface of anterior platen 122 to support the head and legs respectively when a patient lies on his back on the surface of platen 114, and provide friction support to secure the patient disposed between the platens 114/122, when rotated 180 degrees.

Anterior platen 122 includes a removable head-support assembly (not shown), a torso support 174, and leg pads 176 and 178 which support the patient while laying in a prone position, and provide friction support to secure the patient disposed between the platens 114/122, when rotated 180 degrees. Torso support 174 and leg pads 176, 178 are attached to rails 180(1), 180(2), and can slide longitudinally along rails 180 via brackets 182 that fit around rails 180.

Figure 2A:
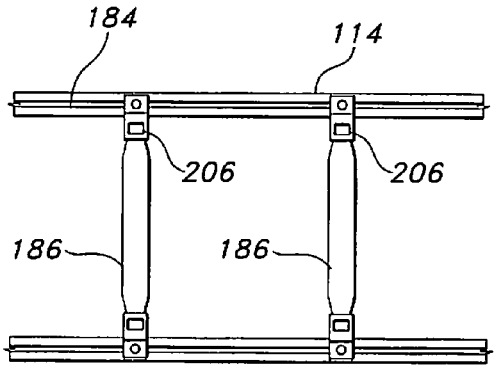
FIG. 2A shows a portion of an exemplary safety-belt system of the system, connected to grooves of the platens.

A groove 184 located on each side of platens 114, 122 permits a safety-belt system (one or more safety belts 186) to be slidably attached to grooves 184 of both platens 114, 122. FIG. 2A shows a side view of a portion of platens 114, 122 showing an exemplary safety-belt system connected to grooves 184. Because the release latches of each safety belt 186 are attached proximal or directly to at least one groove 184 of a platen (in this example 114), only one portion of the two-piece belts may hang down or be conveniently folded under/over a platen 114/122 and out of the way when not in use. This eliminates medical personnel having to deal with two portions of a safety belt, and reduces overall ease and operation of system 100 when connecting and disconnecting platens 114 to 122 using the safety-belt system. In one embodiment, safety belts use mushroom-head pins. With reference to FIG. 1, side padding 190 may be attached to portions of one or more safety belts to fasten the arms of a patient and provide redundant security to prevent a patient from falling out of system 100 when rotated 180 degrees.

Torso support 174 consists two pads in the general shape of Wilson-styled chest frame which supports the outer portions of the side of patient. These pads extend from the upper thighs to the shoulders of a patient. The height of the center portion of the torso support is adjustable by a manual or powered crank system.

Generally, system 100 eliminates the need for operating room staff to manually lift and place patient on and off an operating table.

Various embodiments disclosed herein include several mechanical elements, assemblies and subsystems, such as, but not limited to, dual-rack-and-pinion subsystems, lost-motion devices, gas-shock absorbers, and ratchet-and-pawl subsystems. These mechanical elements, assemblies, and subsystems are combined in a unique manner to provide a patient-safety-transfer system 100 operable to safely rotate a patient from a supine to prone position, and from a prone to supine position.

Regarding the dual-rack-and-pinions in embodiments to be described, each of these allow a top set of racks to extend simultaneously with a lower set of racks comprising the dual-rack-and-pinions. This is used in each COG assembly (described in greater detail below) and provides a self centering function. With respect to lost motion devices, in most application the driven load stops moving when it contacts a fixed stop and the powered device (i.e., columns 102) continue to lower in a free state.

Gas-shock absorbers (described in greater detail below) are used to counter-act large weights in many mechanisms such as a rear hatch door in a vehicle. The gas-shock absorbers are sized to each application in order to reduce free energy caused by gravity as well as provide an ergonomic, realistic amount of energy for human beings to safely perform a given manual function, such as, rotating a patient from supine to prone and vice versa.

Ratchet-and-pawl systems provide mechanisms with the ability to back-drive in one direction and catch in the opposite direction of rotation as is used in COG assemblies 106.

Pre-stage conditions for an illustrative embodiment of the present invention are set as listed below in order to facilitate detailed descriptions of the specifics of the lowering function, latching of COG to posterior and anterior platens, COG self centering features, COG assembly self-centering-ratchet-and-pawl functions, and finally the spindle lost motion functions. More particularly, the pre-stage conditions are: (1) posterior platen 114 is manually pre-staged onto the OR table and each telescopic end 202 (FIG. 2) of platen 114 is advanced into a locked position; (2) a patient is positioned on top of posterior platen 114 for rotation into the prone position; (3) the upper and lower dual-rack-and-pinion shafts 302 and 303 (FIGS. 1A and 3) (to be described) of each COG assembly are extended and locked into their fully extended positions; (4) anterior-platen 122 is already locked onto its respective latches 160 (FIG. 1A) and is rotated in a ready-to-receive position over the top of the patient lying on posterior platen 114 and operating table (not shown); (5) portable-caster-base assemblies 110 have already been located to posterior platen 114 with registration plate 126 mounted to inbound portion of columns 102; and (6) casters are locked in-position.

In practice, a staff member of the hospital or similar facility controls a pendant-control panel (not shown) in order to lift or lower platens onto or off from the operating table. When the pendant button for lowering is actuated, both columns 102 lift and lower simultaneously with respect to each other. The pendant button is depressed and the two lift columns lower the COG assemblies 106. Latch mechanisms 160 mounted on each of the COG assemblies fully nest over the platen tubes 204 (FIG. 1A) during this downward motion. Once contact with platen tubes 204 has occurred, dual-rack-and-pinion system of COG assemblies 106 begins to close and a release mechanism of a ratchet-and-pawl assembly begins to back drive and platens 114/122 adjust themselves to the size of patient (vertical thickness). During this downward self adjusting motion, anterior-platen-foam pads (such as on torso support 174 and leg pads 176, 178 depicted in FIG. 1) eventually make contact with the patient and a controlled patient pad compression is reached. Anterior platen 122, COG assemblies 106, and spindles assemblies 108 stop lowering while the linear motion of columns 102 are free to continue traveling until a limit switch (not shown) is made (approximately two inches of travel). This provides a safe and reliable system for patients, and provides staff members with peace of mind that this system can safely perform its function.

Posterior platen 114 is manually latched onto dual rack and pinion shafts 301, 302 (FIG. 1A and FIG. 3) of the COG assembly 106. Next, safety belts 186 (FIGS. 1 and 2A) are attached and cinched to redundantly secure the patient (in addition to the compression of the padding against the front and back of the patient). Finally the lift and rotate functions are achieved.

Lost Motion System

Spindle assembly 108 mounts on a top portion of lift column 102. In a first case, when lift columns 102 are raised, spindle assemblies 108 stay in contact with the top portion of lift column 102, and therefore COG assemblies (each coupled to the inboard spindle 210 (FIG. 1A) of each of the spindle assembly 108) and platens 114/122 (each coupled to platen-latch mechanisms 160 (FIG. 1A) of COG assemblies 106), are raised.

In a second case, when powered-lift columns 102 are lowered, spindle assemblies 108 stay in contact with the top portion of their respective lift columns 102, and therefore the COG assemblies 106 and platens 114/122 are lowered.

In a third case, when the powered-lift columns 102 are lowered, (i) the platen-latch assemblies 160 are nested on the platen-tube extensions 204, (ii) each COG assembly 106 begins to collapse on itself, (iii) patient-pad contact is made and (iv) platens 114/122, COG assemblies 106, and spindle assemblies 108 stop lowering when columns 102 lower and stop based on contacting an internal limit switch (not shown).

Adjustable COG Assembly

An adjustable COG assembly 106 is mounted to the inboard side of each spindle assembly 108 with a spindle 210 allowing for rotation of COG assembly 106.

Figure 3:
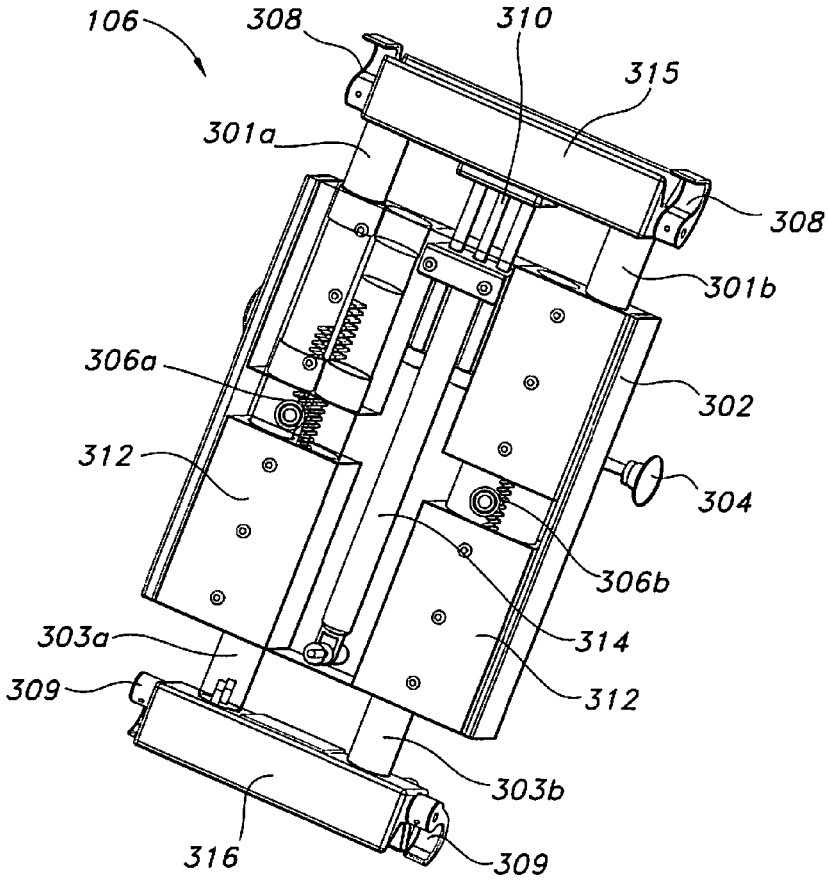
FIG. 3 shows a cut-away view of a COG assembly illustrating the dual-rack-and pinion arrangements, gas-shock absorber, and anterior-and-posterior-platen-latch mechanisms.

Referring to FIG. 3, an illustrative COG assembly 106 is shown with an upper pair of rack shafts 301*a* and 301*b* at least partially disposed within a housing 302 of COG assembly 106. Rack shafts 301*a* and 301*b* are spaced apart from each other by a first distance, and are also each coupled to an anterior-platen latch 315. A lower pair of rack shafts 303*a* and 303*b* are at least partially disposed within housing 302. Lower pair of rack shafts 303*a* and 303*b* are spaced apart from each other by a second distance, and are also each coupled to a posterior-platen latch 316. Rack shafts 301*a* and 303*a* are each coupled to a pinion gear 306*a* to form a first dual rack and pinion arrangement. Rack shafts 301*b* and 303*b* are each coupled to a pinion gear 306*b* to form a second dual rack and pinion arrangement. A gas-shock absorber 314 is disposed in housing 302 and has a piston 310 coupled to anterior platen latch 315. A release knob 304 provides a mechanism to release rack shafts 301*a*, 303*a*, 301*b*, 303*b* in order to expand to their fully extended positions. Latch hooks 308 are mounted to anterior platen latch 315, and in operation latch onto the frame of an anterior platen. Latch hooks 309 are mounted to posterior-platen latch 316, and in operation latch onto the frame of a posterior platen. A latch-and-pawl-system disposed within housing 302 provides a mechanism for the rack and pinion system to collapse and back-drive the pawl mechanism in one direction (i.e., collapse direction of the racks).

COG assembly 106 adjusts open and shut with a dual-rack-and-pinion device to open both or close both posterior and anterior shafts simultaneously. As noted above, platen latch assemblies 315, 316 are mounted to each end respectively of the COG to manually lock onto the platen frames. There is one latch assembly for the posterior platen and one latch assembly for the anterior platen.

Gas-shock absorber 310 performs two functions. The first function is to expand the COG assembly 106 to pre-stage for a pick-up condition. The second function is to provide a metered support force onto a platen (usually the upper platen) when columns 102 are lowering and platen pads make contact with the patient. These shock absorbers 310 will support the majority of the weight of spindle assemblies 108, COG assemblies 106, and a portion of the anterior or posterior platens 114/122.

Figure 5:
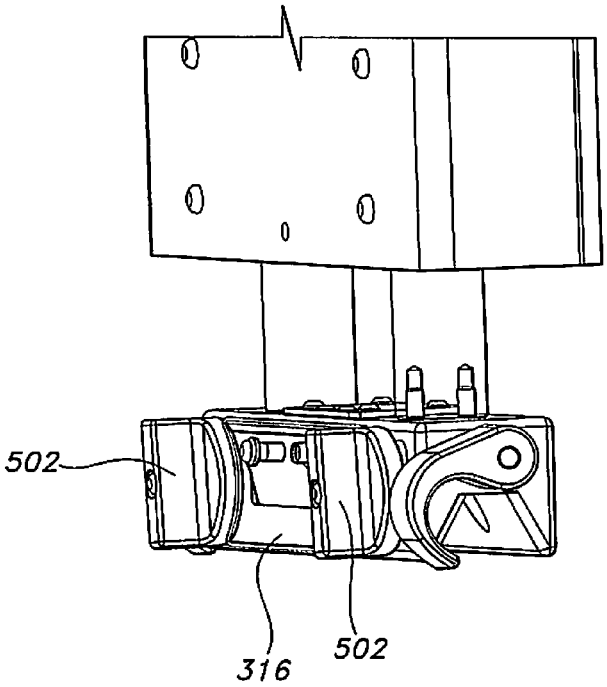
FIG. 5 shows placement of the control knobs for the hook latches of the platen latch mechanism.
Figure 6:
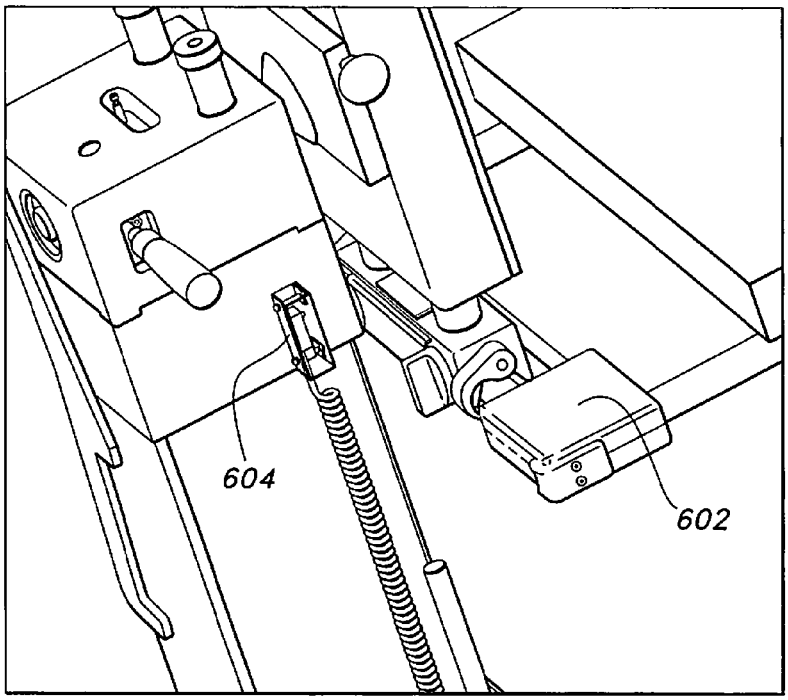
FIG. 6 shows an isometric view of the posterior-platen-latch mechanism coupled to the lower rack shafts of the COG assembly and further coupled to the posterior-platen-tube assembly.

Each end of COG assembly 106 has a platen-latch assembly (anterior platen latch 315 and posterior platen latch 316 respectively). After each column 103 is completely lowered and located onto the tube 204 of the posterior platen and the lost-motion limit switch is made, staff members, or operators, manually turn either one of knobs 502 (FIG. 5) on either side of the posterior-platen latch to engage and clamp onto the lower platen tube assembly 602 (FIG. 6). Final patient compression is validated by pressing down on both sides of the anterior platen and attaching belt systems between the posterior and anterior platens.

Figure 4:
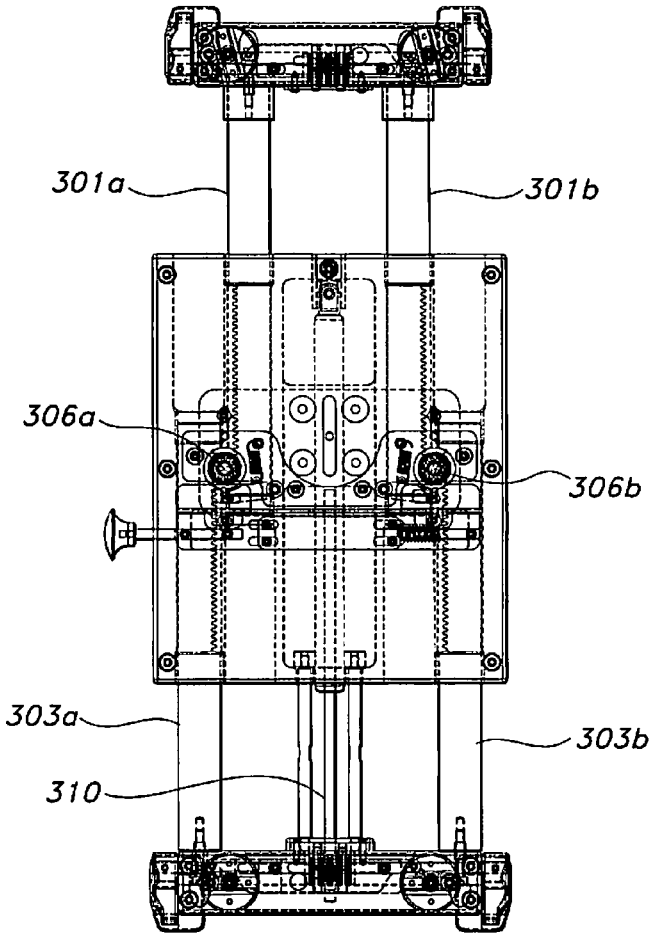
FIG. 4 shows a see-through version of a COG assembly.

FIG. 4 shows a see-through version of COG assembly 106.

In one illustrative embodiment, a system for turning a patient from a supine to prone position and from a prone to supine position, includes a first-lifting column having top end and a bottom end; a second-lifting column having a top end and a bottom end; a first-spindle assembly disposed over the top end of the first-lifting column; a second spindle-assembly disposed over the top end of the second-lifting column; a first-COG assembly coupled to the first-spindle assembly; a second-COG assembly coupled to the second-spindle assembly; a posterior platen having a first-frame assembly, the first-frame assembly coupled to a posterior-platen latch assembly of the first-COG assembly, and further coupled to a posterior-platen-latch assembly of the second-COG assembly; an anterior platen having a second frame assembly, the second-frame assembly coupled to an anterior-platen latch assembly of the first-COG assembly, and further coupled to an anterior-platen latch assembly of the second-COG assembly; and a safety-belt system coupled between the anterior-platen and the posterior platen.

Some embodiments also include a first-caster base coupled to the bottom end of the first-lifting column; and a second-caster base coupled to the bottom end of the second lifting column.

Still other embodiments include a drawbar coupled between the first-caster base and the second-caster base, wherein the drawbar is operable to maintain the coupling of the first and the second-lifting columns while changing the distance between the first and the second-lifting columns by telescoping.

In some of these embodiments, each COG assembly includes a housing; am upper pair of racks, each disposed at least partially within the housing, each coupled to one of a corresponding first pair of pinions, and each of the upper pair of racks spaced apart from each other by a first distance; a lower pair of racks, each disposed at least partially within the housing, each coupled to one of a corresponding second pair of pinions, and each of the lower pair of racks spaced apart from each other by a second distance; wherein the first distance is greater than the second distance.

In another illustrative embodiment, an apparatus suitable for forming part of a patient turning system, includes a COG assembly coupled to a spindle, thereby allowing the COG assembly to rotate about an axis defined by the spindle; a spindle assembly upon which the spindle is attached; a lifting column having a first end and a second end, with the spindle assembly disposed upon the first end; and a caster base to which the second end of the lifting column is attached.

In some embodiments, the caster base includes an attachment point for a drawbar. The lifting column is operable to move the spindle assembly thereby changing the vertical position of the spindle assembly. The COG assembly includes a housing; an upper pair of rack shafts, each disposed at least partially within the housing, each coupled to one of a pair of pinion gears, and each of the upper pair of racks spaced apart from each other by a first distance; a lower pair of rack shafts, each disposed at least partially within the housing, each coupled to one of the pair of pinion gears, and each of the lower pair of racks spaced apart from each other by a second distance; and a gas shock absorber, disposed in the housing and mechanically connected to the anterior-platen-latch assembly; wherein the first distance is greater than the second distance; and wherein a first one of the upper pair of rack shafts and a first one of the lower pair of rack shafts are each coupled to a first-pinion gear of the pair of pinion gears in a first-dual-rack-and-pinion arrangement, and a second one of the upper pair of rack shafts and a second one of the lower pair of rack shafts are each coupled to a second pinion gear of the pair of pinion gears in a second-dual-rack-and-pinion arrangement. It is noted that the ends of the first-dual-rack-and-pinion arrangement and the ends of the second dual rack and pinion arrangement all expand and collapse simultaneously with each other.

Conclusion

The exemplary methods and apparatus illustrated and described herein find application in at least the field of patient safety transport systems.

It is to be understood that the present invention is not limited to the embodiments described above, but encompasses any and all embodiments within the scope of the subjoined Claims and their equivalents.

What is claimed is:

1. An apparatus for turning a patient from a supine to prone position and from a prone to supine position, comprising: a first-lifting column having a top end and a bottom end; a second-lifting column having a top end and a bottom end: a first-spindle assembly disposed over the top end of the first-lifting column; a second-spindle assembly disposed over the top end of the second-lifting column; a first-COG assembly coupled to the first-spindle assembly; a second-COG assembly coupled to the second-spindle assembly; a posterior platen having a first-frame assembly, the first-frame assembly coupled to a posterior-platen-latch assembly of the first-COG assembly, and further coupled to a lower-latch assembly of the second-COG assembly, the posterior platen having a patient support area; an anterior platen having a second-frame assembly, the second-frame assembly coupled to an anterior-platen-latch assembly of the first-COG assembly, and further coupled to an anterior-platen-latch assembly of the second-COG assembly, the anterior platen having a patient-support area; and a safety belt system coupled between the anterior platen and the posterior platen, wherein the first COG assembly comprises: a housing; an upper pair of rack shafts, each disposed at least partially within the housing, each coupled to one of a pair of pinion gears, and each of the upper pair of rack shafts spaced apart from each other by a first distance; a lower pair of rack shafts, each disposed at least partially within the housing, each coupled to one of the pair of pinion gears, and each of the lower pair of racks spaced apart from each other by a second distance; and a gas shock absorber, disposed in the housing and mechanically connected to the anterior platen-latch assembly; wherein the first distance is greater than the second distance; and wherein a first one of the upper pair of rack shafts and a first one of the lower pair of rack shafts are each coupled to a first-pinion gear of the pair of pinion gears in a first-dual-rack-and-pinion arrangement, and a second one of the upper pair of rack shafts and a second one of the lower pair of rack shafts are each coupled to a second-pinion gear of the pair of pinion gears in a second-dual-rack-and-pinion arrangement.

2. The apparatus of claim 1, wherein the first lifting column and the second lifting column are each electrically powered.

3. An apparatus for turning a patient from a supine to prone position and from a prone to supine position, comprising: a first-lifting column having a top end and a bottom end; a second-lifting column having a top end and a bottom end; a first-spindle assembly disposed over the top end of the first-lifting column; a second-spindle assembly disposed over the top end of the second-lifting column; a first-COG assembly coupled to the first-spindle assembly; a second-COG assembly coupled to the second-spindle assembly; a posterior platen having a first-frame assembly, the first-frame assembly coupled to a posterior-platen-latch assembly of the first-COG assembly, and further coupled to a lower-latch assembly of the second-COG assembly, the posterior platen having a patient support area; an anterior platen having a second-frame assembly, the second-frame assembly coupled to an anterior-platen-latch assembly of the first-COG assembly, and further coupled to an anterior-platen-latch assembly of the second-COG assembly, the anterior platen having a patient-support area; and a safety belt system coupled between the anterior platen and the posterior platen, wherein the first frame assembly includes two telescoping shafts, and the second frame assembly includes two telescoping shafts.

4. The apparatus of claim 3, further comprising: a first-caster base coupled to the bottom end of the first-lifting column; and a second-caster base coupled to the bottom end of the second-lifting column.

5. The apparatus of claim 4, further comprising: a drawbar coupled between the first-caster base and the second-caster base; wherein the drawbar is operable to maintain the coupling of the first and the second lifting columns while changing the distance between the first and the second lifting columns by telescoping.

6. The apparatus of claim 3, wherein the telescoping shafts are collapsible to eliminate patient access impediments presented by the outwardly extended telescoping shafts.

7. The apparatus of claim 3, wherein the two telescoping shafts of the first frame assembly are in an outwardly extending configuration to couple with the lower latch assembly of the first COG assembly and the lower latch assembly of the second COG assembly.

8. The apparatus of claim 3, wherein the two telescoping shafts of the second frame assembly are in an outwardly extending configuration to couple with the upper latch assembly of the first COG assembly and the upper latch assembly of the second COG assembly.

9. The apparatus of claim 3, wherein the telescoping shafts of the posterior platen extend outwardly from the posterior-platen-patient-support area by a distance suitable to provide a safe distance away from the first and the second COG assemblies for the patient; and the telescoping shafts of the anterior platen extend outwardly from the anterior-platen-patient-support area by a distance suitable to provide a safe distance away from the first and the second COG assemblies for the patient.

10. An apparatus suitable for forming part of a patient turning system, comprising: a COG assembly coupled to a spindle, thereby allowing the COG to rotate about an axis defined by the spindle; a spindle assembly upon which the spindle is attached; a lifting column having a first end and a second end, with the spindle assembly disposed upon the first end; and a caster base to which the second end of the lifting column is attached, wherein the COG assembly comprises: a housing; an upper pair of rack shafts, each disposed at least partially within the housing, each coupled to one of a pair of pinion gears, and each of the upper pair of racks spaced apart from each other by a first distance; a lower pair of rack shafts, each disposed at least partially within the housing, each coupled to one of the pair of pinion gears, and each of the lower pair of racks spaced apart from each other by a second distance; a gas-shock absorber, disposed in the housing and mechanically connected to the anterior-platen-latch assembly; an anterior-platen-latch assembly coupled to the upper pair of rack shafts; and a posterior-platen-latch assembly coupled to the lower pair of rack shafts; wherein the first distance is greater than the second distance; and wherein a first one of the upper pair of rack shafts and a first one of the lower pair of rack shafts are each coupled to a first-pinion gear of the pair of pinion gears in a first-dual-rack-and-pinion arrangement, and a second one of the upper pair of rack shafts and a second one of the lower pair of rack shafts are each coupled to a second pinion gear of the pair of pinion gears in a second-dual-rack-and-pinion arrangement.

11. The apparatus of claim 10, wherein the caster base includes an attachment point for a drawbar.

12. The apparatus of claim 10, wherein the lifting column is operable to move the spindle assembly thereby changing the vertical position of the spindle assembly.

13. The apparatus of claim 10, wherein the ends of the first-dual rack-and-pinion arrangement and the ends of the second-dual-rack-and-pinion arrangement all expand and collapse simultaneously with each other.

14. The apparatus of claim 13, further comprising a ratchet-and-pawl system coupled the first-dual-rack-and-pinion arrangement and further coupled to the second-dual-rack and-pinion arrangement.

15. The apparatus of claim 14, further comprising a release knob coupled to the ratchet-and-pawl system, the release knob operable to release the first and the second-dual-rack-and-pinion arrangements and permit the rack shafts to move into the fully extended position.

* * * * *